US005709355A

United States Patent [19]

Kinnunen et al.

[11] Patent Number: 5,709,355

[45] Date of Patent: Jan. 20, 1998

[54] SPLICING DEVICE FOR A CONTINUOUS UNWIND STAND

[75] Inventors: Jorma Kinnunen, Helsinki; Silvo Mikkonen, Vantaa, both of Finland

[73] Assignee: Valmet Corporation, Helsinki, Finland

[21] Appl. No.: 600,936

[22] PCT Filed: Jun. 14, 1995

[86] PCT No.: PCT/FI95/00345

§ 371 Date: Feb. 15, 1996

§ 102(e) Date: Feb. 15, 1996

[87] PCT Pub. No.: WO95/34496

PCT Pub. Date: Dec. 21, 1995

[30] Foreign Application Priority Data

| | | | |
|---|---|---|---|
| Jun. 16, 1994 | [FI] | Finland | 942869 |
| Apr. 28, 1995 | [FI] | Finland | 952038 |

[51] Int. Cl.[6] ..... B65H 19/18

[52] U.S. Cl. ..... 242/555.3; 242/556.1

[58] Field of Search ..... 242/555.3, 555.4, 242/555.5, 555.6, 555.7, 556.1

[56] References Cited

U.S. PATENT DOCUMENTS

| | | | |
|---|---|---|---|
| 1,967,056 | 7/1934 | Horton | 242/555.6 |
| 3,276,710 | 10/1966 | Zernov et al. | 242/555.3 |
| 3,915,399 | 10/1975 | Kron et al. | 242/555.6 |
| 4,009,841 | 3/1977 | Matalia | 242/556.1 |
| 4,763,851 | 8/1988 | Flament | 242/555.4 |
| 4,936,942 | 6/1990 | Sollinger et al. | 156/504 |

FOREIGN PATENT DOCUMENTS

| | | |
|---|---|---|
| 88386 | 12/1988 | Finland . |
| 1250709 | 7/1961 | Germany . |
| 3115835 | 10/1982 | Germany . |
| 4222251 | 1/1994 | Germany . |

*Primary Examiner*—John M. Jillions

*Attorney, Agent, or Firm*—Steinberg, Raskin & Davidson, P.C.

[57] ABSTRACT

A splicing device for a continuous unwind stand for splicing a web of a new machine reel at full speed with a web of a machine reel being emptied including a frame, a first splicing roll and a second roll, the web of the machine reel being emptied running over the first and second rolls, and an elongate lever member having first and second opposed ends. The first roll is mounted at the first end and the second roll is mounted at the second end of the lever and the lever is pivotally mounted to the frame for pivoting between a first basic running position in which the first roll is spaced from the new machine reel and a second splicing position in which the first roll is in nip-defining engagement with the new machine reel and the new machine reel is spliced to the web of the machine reel being emptied. The lever pivots about an articulation point situated between a central axis of the first roll and a central axis of the second roll. The location of the articulation point is selected such that the length of a run of the web from a separation point on the machine reel being emptied to the guide roll is substantially constant during splicing and during unwinding.

22 Claims, 3 Drawing Sheets

13
11
12a
W2
17
W1
12b
16
20
S1
S2
P
19
P1
P2
18

SPLICING DEVICE FOR A CONTINUOUS UNWIND STAND

FIELD OF THE INVENTION

The invention concerns a splicing device for a continuous unwind stand, by means of which device the new machine reel brought to the unwind stand is connected at full speed with the web of the machine reel that is being emptied, which splicing device comprises a splicing roll, by whose means the web of the machine reel that is being emptied is pressed into contact with the splice placed on the new machine reel.

BACKGROUND OF THE INVENTION

In off-machine coating machines, a continuous unwind stand is used, in which the new machine reel brought to the unwind stand is connected at full speed with the tail of the machine reel that is being emptied. With modern high-speed coating machines, the splicing method is, in principle, the same irrespective of the manufacturer of the machine. To the end of the web of the new machine reel, a splice is prepared by means of a two-sided adhesive tape, which splice is attached to the face of the reel by means of pieces of fastening tape. The surface speed of the new machine reel is accelerated to a speed equal to the running speed of the machine, after which the web of the machine reel that is being emptied is pressed into contact with said splice by means of a roll or brush. The old web is cut off by means of a blade from above the splice.

At the current running speeds (1200 to 1600 metres per minute) the splicing at the unwind stand has become problematic. This is why the running speed of the coating machine is often lowered for the time of splicing. At high running speeds, the most important causes of the problem of splicing are air currents and the required high speed of movement of the splicing roll. At a high speed, a negative pressure is formed in the so-called splicing gap between the splicing roll that has been brought to the vicinity and the machine reel, which negative pressure may be pulsating if the new machine reel is non-circular or eccentric. The negative pressure attempts to pull the old web partly into contact with the splice even before splicing, and it also causes fluttering of the old web, Moreover, the negative pressure attempts to detach the tape splice from the face of the new machine reel, in which case the new machine reel "explodes" before splicing. In order that the run of the web could be controlled, a bend is needed at the splicing roll, which again requires stretching of the web when the splicing roll is hit quickly against the face of the new machine reel. Attempts are made to keep the tension peak produced by the hitting of the roll in connection with the splicing low by using a small splicing gap (8 mm to 12 mm), which produces an intensive phenomenon of negative pressure. Even the bend angle that is used currently produces a problematic tension peak in the web. At high running speeds, an even larger bend angle would be required.

Thus, in the splicing devices of a continuous unwind stand, the principal problems are the high speed of the stroke of the splicing roll, the large bending angle of the web, and the negative pressure formed in the splicing gap. The negative pressure produces detrimental fluttering, and the possibility of detaching of the tape used for splicing is very high. When a large splicing gap is used, the risk of web break is increased. Likewise, when a large bending angle is used, the risk of web break is increased. When the splicing gap is made smaller, the consequence is an increased negative pressure and the resulting detrimental effects. When the splicing gap is made larger, the tension peak applied to the web, i.e. the risk of web break, becomes higher.

At present, as the splicing device of a continuous unwind stand, a splicing roll is commonly used, which usually has a 35 mm thick soft rubber face. The core material of the splicing roll is, as a rule, steel, but it may also be of some other material, such as, for example, carbon fibre.

OBJECTS AND SUMMARY OF THE INVENTION

The object of the present invention is to provide an improvement of the prior-art splicing devices of continuous unwind stands. A more specific object of the invention is to provide a splicing device for a continuous unwind stand, in which device the numerous detrimental factors present in the prior-art solutions are avoided.

The splicing device in accordance with the invention for a continuous unwind stand is characterized in that the splicing device comprises at least one second roll, and that the splicing roll and said second roll are attached to a lever device, which is mounted by means of an articulation point placed between the shafts of said rolls so that the run of the web before splicing and the run of the web during splicing are such that the length of the web during splicing and when said rolls are in their basic positions is substantially equal.

In the splicing device in accordance with the invention, the stretching of the web during striking of the splicing roll is eliminated by using two mobile rolls. Since the stretch of the web during movements of the rolls has been compensated for, it is possible to use a large splicing gap, such as, for example, 100 mm, in which case no disturbing negative pressure is formed in the splicing gap. This is why fluttering of the web is reduced and the risk of disintegration of the new machine reel becomes lower. In the solution in accordance with the present invention, the bending angle on the splicing roll can be increased, in which case the run of the web becomes more controlled. Nor is there a risk of premature adhesion of the web to the splicing tape in the solution in accordance with the invention.

In a preferred embodiment of the invention, the two rolls of the splicing device are attached to a lever, which is linked from an articulation point placed between the shafts of the rolls. The location of the articulation point is chosen depending on the bending angles at the splicing roll and the web guide roll, i.e. auxiliary roll, so that the length of the web during splicing and when the rolls are in their basic positions is substantially equal. In large machines, in which the roll diameters are large, it is possible to use low-weight composite rolls, in which case the weight of the splicing-roll mechanism does not become disturbingly large.

In a second preferred embodiment of the invention, a support wire is fitted to pass over the splicing roll and the auxiliary roll, in which case, besides a roll nip, also a wire nip is formed. In such a case, the time of adhesion in the splicing is multiplied in comparison with a situation in which the splicing roll and the new machine reel form a roll nip alone. Moreover, in the solution in accordance with the invention, the adhesion of the splicing tape takes place even at a low gluing pressure, because the time of adhesion is sufficiently long. Thus, in the invention, it has been realized to increase the time of adhesion by increasing the distance over which the splicing tape is under pressure.

BRIEF DESCRIPTION OF THE DRAWINGS

The invention will be described in detail with reference to a preferred embodiment of the invention illustrated in the figures in the accompanying drawings, the invention being, however, not supposed to be confined to said embodiment alone.

DETAILED DESCRIPTION OF THE PREFERRED EMBODIMENTS

Figure 1A:
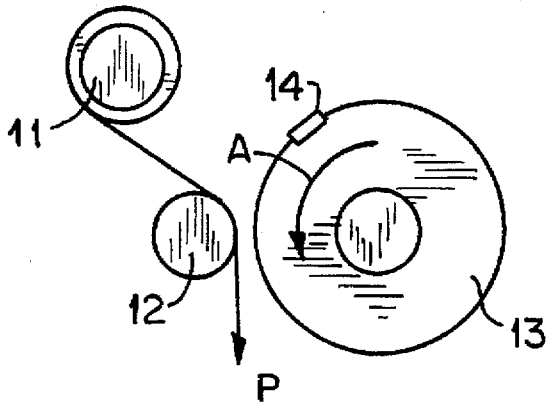
FIG. 1A PRIOR ART
FIGS. 1A, 1B and 1C are side views of a prior-an splicing mechanism.
Figure 1B:
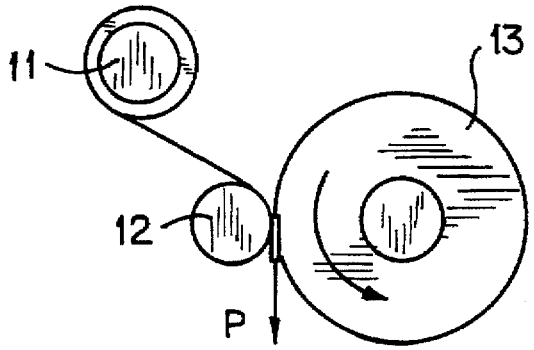
FIG. 1B PRIOR ART
Figure 1C:
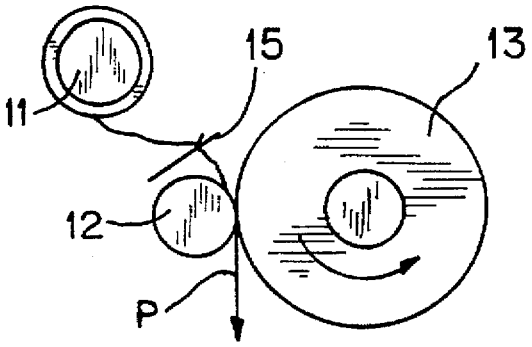
FIG. 1C PRIOR ART

In FIGS. 1A, 1B and 1C, the machine reel that is being emptied is denoted with the reference numeral 11 and the splicing roll with the reference numeral 12. The new machine reel is denoted with the reference numeral 13 and its sense of rotation with the arrow A. The tape splice is denoted with the reference numeral 14.

In the prior-art solution the new machine reel 13 is accelerated to the running speed, and the old web P is brought close to the face of the new machine reel 13. After this, the web P is pressed onto the face of the machine reel 13 by means of the splicing roll 12. The old web P is cut off by means of a cutting blade 15 above the splice 14. The prior-art splicing mechanism as shown in FIGS. 1A, 1B and 1C involves the drawbacks that have been described above.

Besides the splicing roll 12*a*, the splicing device in accordance with the invention comprises at least one second roll 12*b*, which is an auxiliary roll and, at the same time, a web guide roll. The rolls 12*a* and 12*b* are mounted on a lever 16, which is linked from an articulation point 17 placed between the shafts of the rolls 12*a* and 12*b*. The distance of the articulation point 17 from the shaft of the roll 12*a* is denoted with the reference $S_1$, and the distance from the shaft of the roll 12*b* with the reference $S_2$. The run of the web P before splicing is denoted with the reference $W_1$, and the run of the web P during splicing with the reference $W_2$. After the splicing device the web P runs further over the guide roll 18. The actuator of the splicing device is denoted with the reference numeral 19. The actuator 19 gives the splicing roll 12*a* a sufficiently quick stroke. The speed can be limited to the desired value by means of a viscous attenuator 20.

Figure 2:
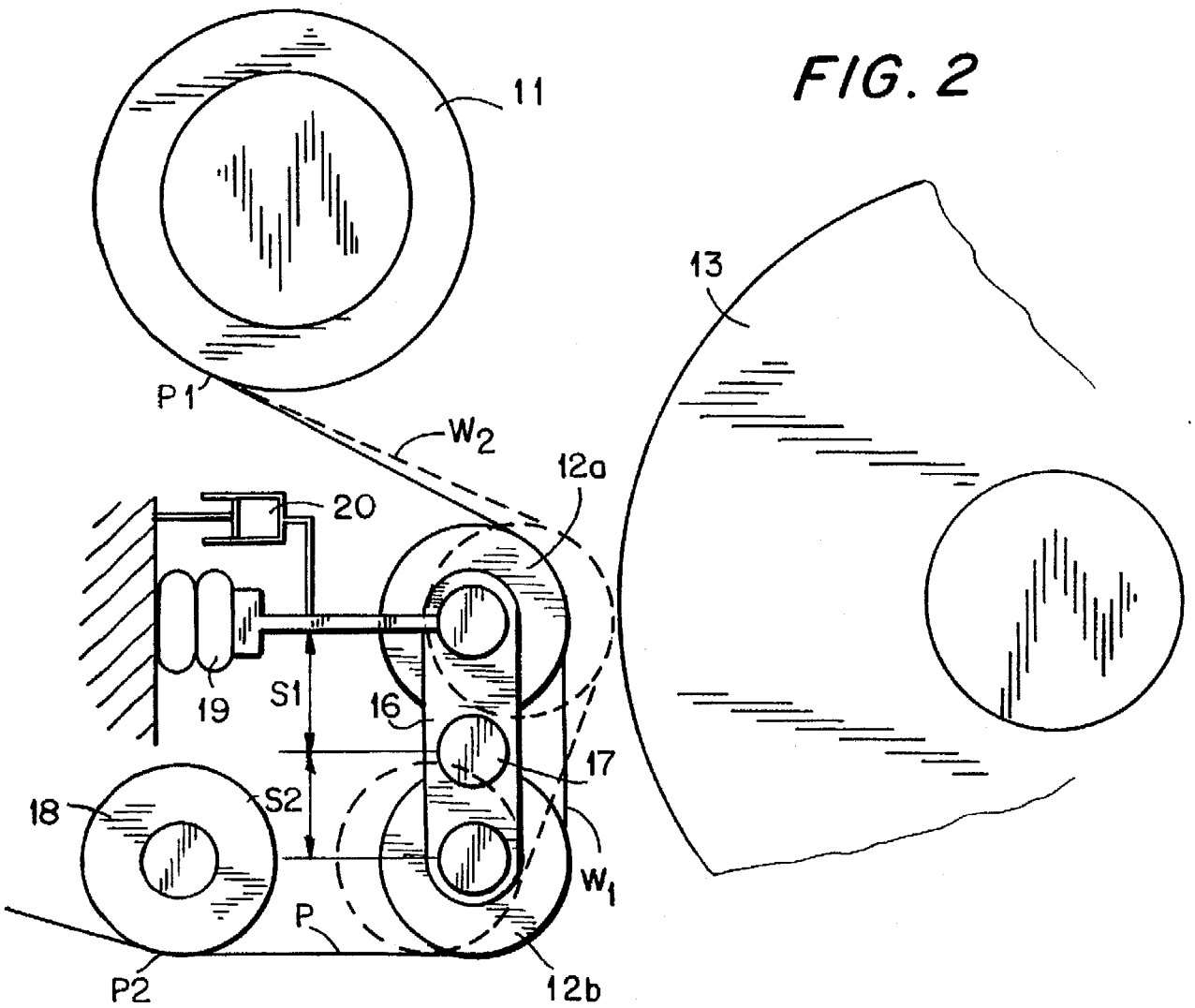
FIG. 2 is a side view of a preferred embodiment of a splicing device in accordance with the invention.

The location of the articulation point 17, i.e. the distances $S_1$ and $S_2$, are chosen, depending on the bending angles at the splicing roll 12*a* and the auxiliary roll 12*b*, so that the length of the web during splicing and when the rolls 12*a* and 12*b* are in the basic positions is substantially equal. In FIG. 2, the run of the web before the splicing $W_l$, i.e. the distance from the point $P_1$ to the point $P_2$, is substantially equally long as the run of the web P during splicing $W_2$. $P_1$ refers to the point of separation of the web P from the reel 11 to be unwound, and $P_2$ refers to the point of arrival of the web P on the guide roll 18.

In the embodiment as shown in FIG. 2, as the actuator 19, a pneumatic bellows has been used, which is provided with a, for example, hydraulic attenuator 20. In particular in large machines, for example large coating machines, in which the roll diameters are large, it is possible to use low-weight composite rolls as the rolls 12*a* and 12*b*, in which case the weight of the splicing-roll mechanism does not become disturbingly large. The web-guide roll, i.e. the auxiliary roll 12*b*, does not necessarily have to be a composite roll, but it may be, for example, a steel roll.

Thus, in the solution in accordance with the invention, it has been realized to increase the splicing gap from the present-day gap size of about 8 mm to 12 mm, for example, up to 100 mm or even beyond. Further, in the solution of the invention, it has been possible to increase the bending angle without any detrimental effect.

Figure 3:
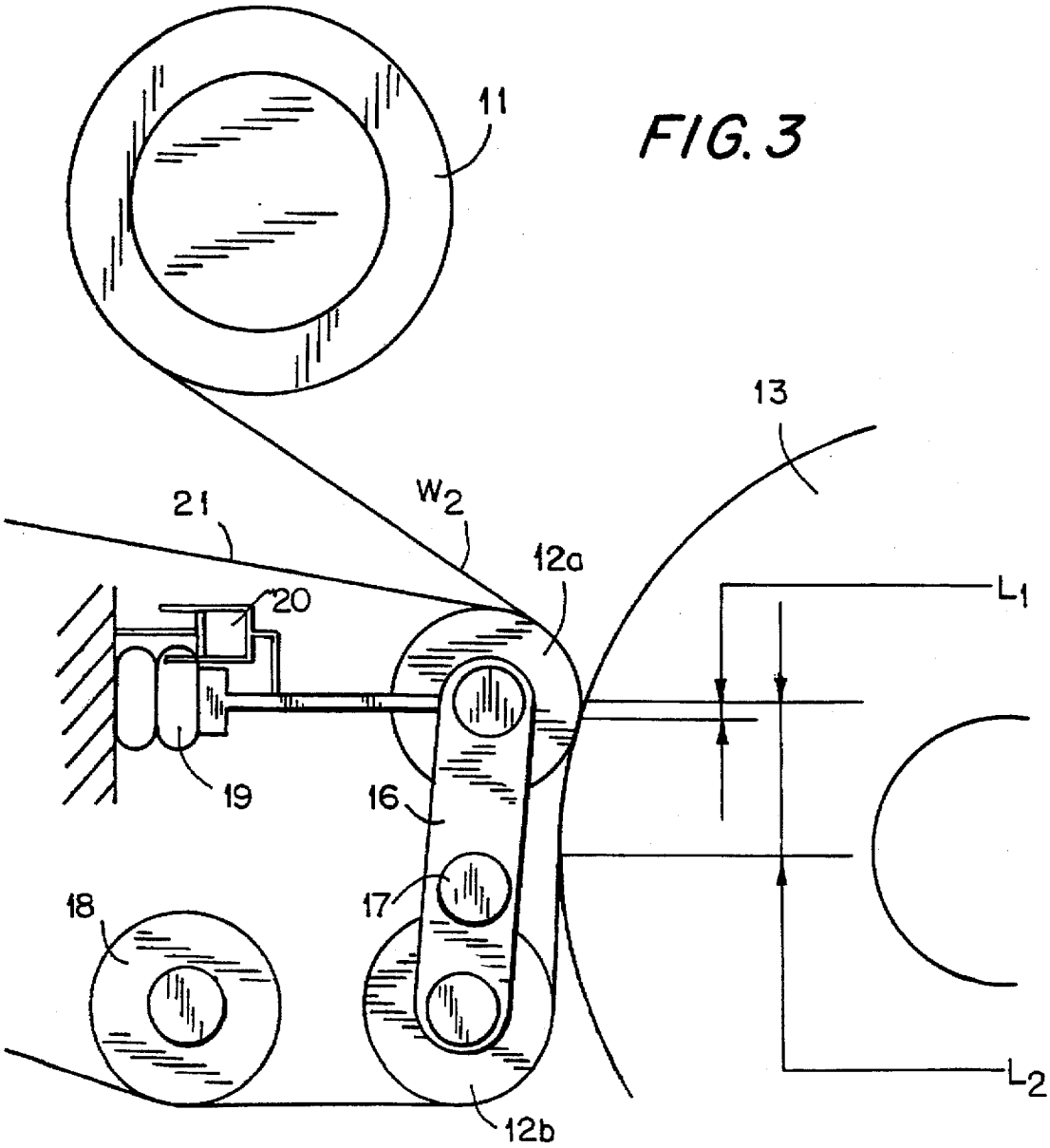
FIG. 3 is a side view of a second preferred embodiment of a splicing device in accordance with the invention.

In the solution shown in FIG. 3, the support wire 21 is fitted to pass over the splicing roll 12*a* and over the auxiliary roll 12*b*, in which case, besides the roll nip $L_1$, also a wire nip $L_2$ is formed. Of course, in the embodiment shown in FIG. 3, the support wire 21 also runs further over the guide roll 18.

In the embodiment shown in FIG. 3, the time of adhesion in the splicing is increased to a multiple as compared with the situation as per FIG. 2. Moreover, the adhesion of the splicing tape takes place even with a low gluing pressure, because the time of adhesion is sufficiently long. Thus, in the embodiment shown in FIG. 3, it has been realized to increase the gluing time by increasing the distance over which the splicing tape is under pressure.

The embodiment shown in FIG. 3 can be illustrated by means of the following practical example.

The length of the roll nip $L_1$ is, as a rule, of an order of 20 mm to 30 mm. In a corresponding way, the length of the wire nip $L_2$ is, as a rule, of an order of 200 mm to 1000 mm. For example, if the length of the roll nip $L_1$ is 25 mm and the nip pressure is 100 kP, the time of dwell is 1 ms. If the length of the wire nip $L_2$ is 600 mm and the pressure is 5 kP, the time of dwell is 24 ms. This has been calculated with a wire tension of 6000 N/m, with a machine-reel diameter of 2.5 m, and with a running speed of 1500 m per minute. From the example it is seen directly that, owing to the solution as shown in FIG. 3, the time of adhesion of the splicing tape can be made multiple, i.e., in this example, 24-fold.

Above, just one preferred embodiment of the invention has been described, and it is obvious to a person skilled in the art that numerous modifications can be made to said embodiment within the scope of the inventive idea defined in the accompanying patent claims.

We claim:

1. A splicing device for a continuous unwind stand, by means of which device a new machine reel (13) brought to the unwind stand is connected at full speed with a web (P) of a machine reel (11) that is being emptied, which splicing device comprises a splicing roll (12*a*), by whose means the web of the machine reel (11) that is being emptied is pressed into contact with a splice (14) placed on the new machine reel (13), wherein the splicing device comprises at least one second roll (12*b*), and that the splicing roll (12*a*) and said second roll (12*b*) are attached to a lever device (16), which is mounted by means of an articulation point (17) placed between shafts of said rolls (12*a*, 12*b*) so that the run of the web (P) before splicing ($W_1$) and the run of the web (P) during splicing ($W_2$) are such that the length of the web (P) during splicing and during unwinding of the web before splicing is substantially equal, a first bend angle being defined as the angle of curvature of the web over said splicing roll and a second bend angle being defined as the angle of curvature of the web over said at least one second roll, the distance between the articulation point and said shaft of said splicing roll and said shaft of said at least one second roll being dependent on said first and second bend angles.

2. A splicing device as claimed in claim 1, characterized in that a support wire (21) is fitted to pass over the splicing roll (12*a*) and over said second roll (12*b*) so as to form a wire nip ($L_2$), whereby the duration of the gluing time available for splicing is multiplied.

3. A splicing device as claimed in claim 2, characterized in that the length of the wire nip ($L_2$) is 200 to 1000 mm.

4. A splicing device as claimed in claim 1, characterized in that at least the splicing roll (12*a*) is a low-weight composite roll.

5. A splicing device as claimed in claim 1, characterized in that the distance of the splicing roll (12*a*) from the new machine reel (13), i.e. the splicing gap, is in the range of 12 to 100 mm.

6. A splicing device as claimed in claim 1, further comprising an actuator (19) for displacing the splicing roll (12*a*) by pivoting said lever device (16) about said articulation point (17), and an attenuation device (20) coupled to said actuator for limiting the speed of the pivoting of said lever device (16).

7. A splicing device as claimed in claim 6, characterized in that the actuator (19) is a pneumatic bellows, and the attenuation device (20) is a hydraulic attenuator.

8. A splicing device for a continuous unwind stand for splicing a web of a new machine reel at full speed with a web of a machine reel being emptied, comprising a frame, a first splicing roll and a second roll, the web of the machine reel being emptied running over said first and second rolls, said first roll rotating about a first shaft and said second roll rotating about a second shaft, a first bend angle being defined as the angle of curvature of the web over said first roll and a second bend angle being defined as the angle of curvature of the web over said second roll, and an elongate lever member having first and second opposed ends, said first shaft of said first roll being mounted at said first end and said second shaft of said second roll being mounted at said second end, and said lever being pivotably mounted to said frame for pivoting between a first basic unwinding position in which said first roll is spaced from the new machine reel and a second splicing position in which said first roll is in nip-defining engagement with the new machine reel and the new machine reel is spliced to the web of the machine reel being emptied, said lever pivoting about an articulation point situated between a central axis of said first roll and a central axis of said second roll, the distance between said articulation point and said first shaft and said second shaft being dependent on said first and second bend angles.

9. The splicing device of claim 8, further comprising a guide roll arranged after said first and second rolls in the direction of web travel, said articulation point being positioned between said central axis of said first roll and said central axis of said second roll such that the length of a run of the web from a separation point on the machine reel being emptied to said guide roll is substantially constant during unwinding of the web when said lever is in said first position and during splicing when said lever is in said second position.

10. The splicing device of claim 8, further comprising a support wire and guide means for guiding said support wire in a run over said first roll and said second roll to thereby form a wire nip between said support wire and the new machine reel when said lever is in said second position and said first roll is in nip-defining engagement with the new machine reel.

11. The splicing device of claim 10, wherein said wire nip has a length from about 200 mm to about 1000 mm.

12. The splicing device of claim 8, wherein said first roll is a low-weight composite roll.

13. The splicing device of claim 8, wherein said first roll is spaced from the new machine reel from about 12 mm to about 100 mm when said lever is in said first position.

14. The splicing device of claim 8, further comprising actuator means coupled to said lever for pivoting said lever about said articulation point, and an attenuation device coupled to said actuator means for limiting the speed of the pivoting of said lever.

15. The splicing device of claim 14, wherein said actuator means comprise a pneumatic bellows and said attenuation device comprises a hydraulic attenuator.

16. The splicing device of claim 8, wherein said first roll is situated in advance of said second roll in a direction of web travel.

17. A method for splicing a new machine reel at full speed with a web of a machine reel being emptied, comprising the steps of:

mounting a first splicing roll and a second roll to a lever and in opposed relationship to the new machine reel, passing the web of the machine reel being emptied over the first and second rolls, rotating the lever in a first direction about an articulation point situated between a central axis of the first roll and a central axis of the second roll such that the first roll moves into nip-defining engagement with the new machine reel and the web of the machine reel being emptied engages with a splice on the new machine reel, and selecting the distance between the articulation point and the central axis of the first roll and the central axis of the second roll based on a first bend angle defined as the angle of curvature of the web over the first roll and a second bend angle defined as the angle of curvature of the web over the second roll.

18. The method of claim 17, further comprising the steps of:

rotating the lever after the web of the new machine reel is spliced to the web of the machine reel being emptied in a second direction opposite to the first direction such that the first roll moves away from the new machine reel after the web of the new machine reel is spliced to the web of the machine reel being emptied.

19. In a splicing device for a continuous unwind stand by means of which a new machine reel brought to the unwind stand is connected at full speed with a web of a machine reel that is being emptied, the splicing device comprises a splicing roll for pressing the web of the machine reel that is being emptied into contact with a splice placed on the new machine reel, the improvement comprising at least one second roll, a lever device, the splicing roll and said at least one second roll being attached to said lever device, said lever device being mounted by means of an articulation point placed between shafts of said splicing roll and said at least one second roll such that a run of the web before splicing and the run of the web during splicing are such that the length of the web during splicing and during unwinding of the web before splicing is substantially equal, and a support wire fitted to pass over the splicing roll and over said at least one second roll so as to form a wire nip.

20. In a splicing device for a continuous unwind stand by means of which a new machine reel brought to the unwind stand is connected at full speed with a web of a machine reel that is being emptied, the splicing device comprises a splicing roll for pressing the web of the machine reel that is being emptied into contact with a splice placed on the new machine reel, the improvement comprising at least one second roll, a lever device, the splicing roll and said at least one second roll being attached to said lever device, said lever device being mounted by means of an articulation point placed between shafts of said splicing roll and said at least one second roll such that a run of the web before splicing and the run of the web during splicing are such that the length of the web during splicing and during unwinding of the web before splicing is substantially equal, an actuator for displacing the splicing roll by pivoting said lever device about said articulation point, and an attenuation device coupled to said actuator for limiting the speed of the pivoting of said lever device.

21. A splicing device for a continuous unwind stand for splicing a web of a new machine reel at full speed with a web of a machine reel being emptied, comprising a frame, a first splicing roll and a second roll, the web of the machine reel being emptied running over said first and second rolls, an elongate lever member having first and second opposed ends, said first roll being mounted at said first end and said second roll being mounted at said second end, and said lever being pivotably mounted to said frame for pivoting between a first basic unwinding position in which said first roll is spaced from the new machine reel and a second splicing position in which said first roll is in nip-defining engagement with the new machine reel and the new machine reel is spliced to the web of the machine reel being emptied, said lever pivoting about an articulation point situated between a central axis of said first roll and a central axis of said second roll, and a support wire and guide means for guiding said support wire in a run over said first roll and said second roll to thereby form a wire nip between said support wire and the new machine reel when said lever is in said second position and said first roll is in nip-defining engagement with the new machine reel.

22. A splicing device for a continuous unwind stand for splicing a web of a new machine reel at full speed with a web of a machine reel being emptied, comprising a frame, a first splicing roll and a second roll, the web of the machine reel being emptied running over said first and second rolls, an elongate lever member having first and second opposed ends, said first roll being mounted at said first end and said second roll being mounted at said second end, and said lever being pivotably mounted to said frame for pivoting between a first basic unwinding position in which said first roll is spaced from the new machine reel and a second splicing position in which said first roll is in nip-defining engagement with the new machine reel and the new machine reel is spliced to the web of the machine reel being emptied, said lever pivoting about an articulation point situated between a central axis of said first roll and a central axis of said second roll, actuator means coupled to said lever for pivoting said lever about said articulation point, and an attenuation device coupled to said actuator means for limiting the speed of the pivoting of said lever.

* * * * *